United States Patent [19]

Hantsch et al.

[11] Patent Number: 5,067,076

[45] Date of Patent: Nov. 19, 1991

[54] CIRCUIT ARRANGEMENT FOR SERIAL DATA TRANSFER

[75] Inventors: Hartmut Hantsch, Bad Friedrichshall; Peter Thoma, Hollern; Josef Mahalek, Neufahrn, all of Fed. Rep. of Germany

[73] Assignees: Bayerische Motoren Werke Aktiengesellschaft, Munich; Telefunken Electronic GmbH, Heilbronn, both of Fed. Rep. of Germany

[21] Appl. No.: 685,179

[22] Filed: Apr. 15, 1991

Related U.S. Application Data

[63] Continuation of Ser. No. 323,203, Mar. 13, 1989, abandoned, which is a continuation of Ser. No. 940,396, Dec. 11, 1986, abandoned.

[30] Foreign Application Priority Data

Dec. 20, 1985 [DE] Fed. Rep. of Germany ..... 3645293

[51] Int. Cl.[5] ..... H04J 3/08

[52] U.S. Cl. ..... 395/275; 340/825.02; 340/825.04; 340/825.06; 364/239.2; 364/DIG. 1

[58] Field of Search ..... 364/200, 900; 340/825.06

[56] References Cited

U.S. PATENT DOCUMENTS

| | | | |
|---|---|---|---|
| 3,975,712 | 8/1976 | Hepworth et al. | 364/200 X |
| 4,071,887 | 1/1978 | Daly et al. | 364/200 |
| 4,200,936 | 4/1980 | Borzcik et al. | 364/900 |
| 4,271,518 | 6/1981 | Birzele et al. | 371/37 |
| 4,375,078 | 2/1983 | Thoma | 364/200 |
| 4,388,683 | 6/1983 | Beifuss et al. | 364/200 |
| 4,710,922 | 12/1987 | Scott | 370/112 |
| 4,717,914 | 1/1988 | Scott | 370/55 X |

*Primary Examiner*—Gary V. Harkcom
*Assistant Examiner*—Michael A. Jaffe
*Attorney, Agent, or Firm*—Spencer & Frank

[57] ABSTRACT

A circut arrangement for serial data transfer has a transmitting device with several bit-parallel input information units, a serial data transfer line and a receiving device via which the transferred data are correspondingly converted into bit-parallel output information units to drive control elements or logic circuits. The data to be transferred forms on the data transfer line a data word composed of a start pulse, several information units corresponding to the number of bit-parallel input information units forming a data block, and a defined data pause. By cascading several transmitting and receiving devices of the same kind, the number of bit-parallel, input and output information units can be altered, whereby the data word on the data transfer line is also altered by sequential joining of a corresponding number of data blocks, each having the same number of information units.

11 Claims, 5 Drawing Sheets

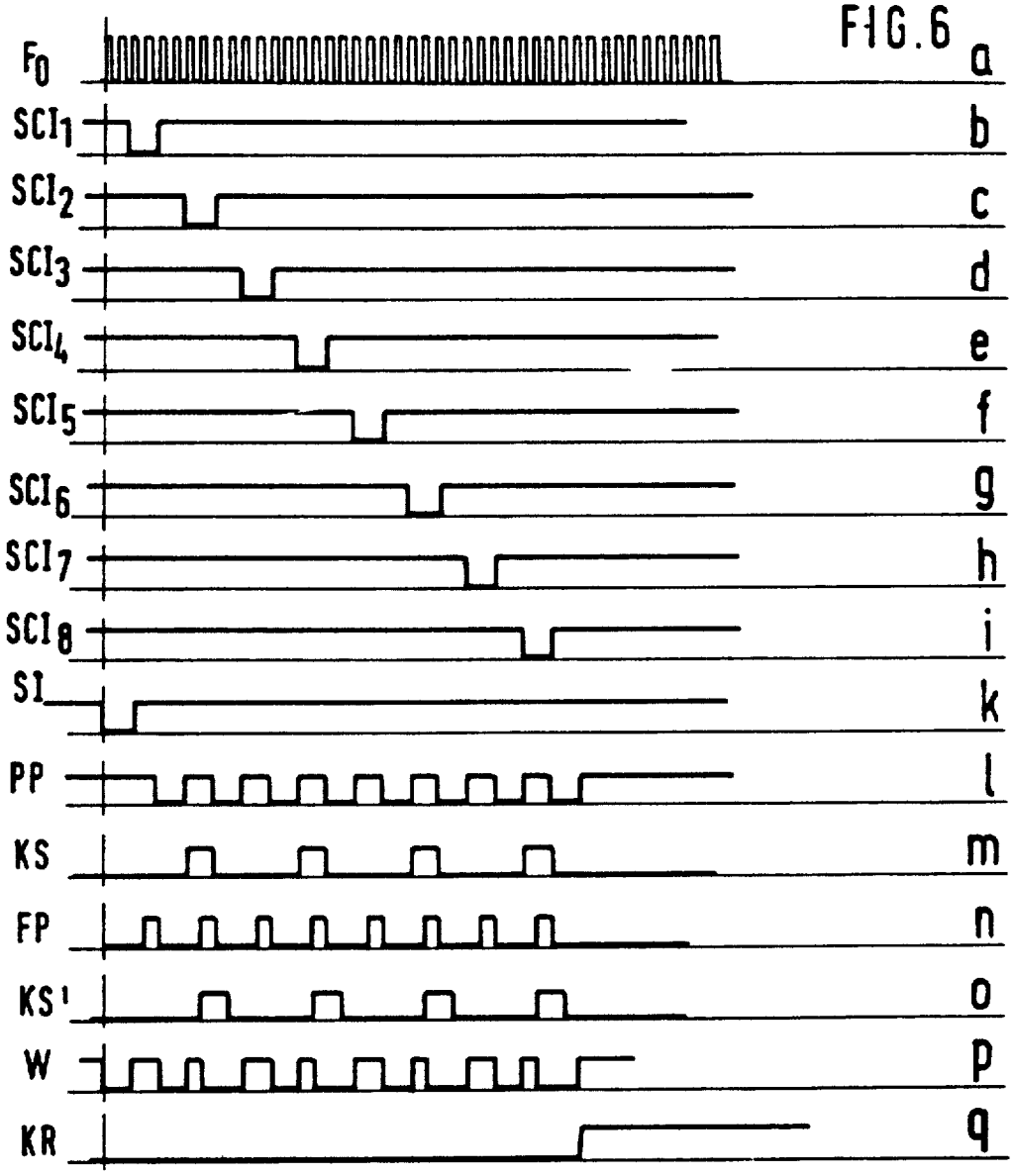
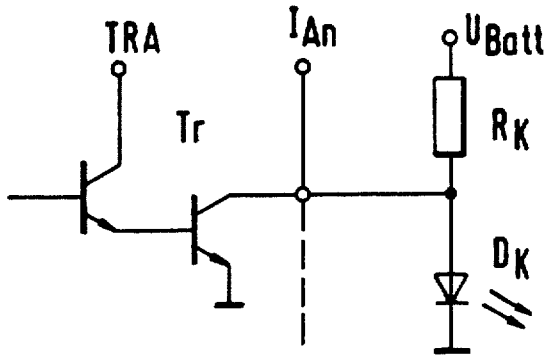
FIG.7

CIRCUIT ARRANGEMENT FOR SERIAL DATA TRANSFER

This application is a continuation of application Ser. No. 07/323,203, filed Mar. 13th, 1989, now abandoned, which is a Continuation of application Ser. No. 06/940,396, filed Dec. 11th, 1986, now abandoned.

BACKGROUND OF THE INVENTION

The invention relates to an electronic circuit arrangement for serial data transfer with a transmitting device with several bit-parallel input information units, a serial data transfer line and a receiving device via which the transferred data are correspondingly converted into bit-parallel output information units to drive control elements or logic circuits, with the data to be transferred forming on the data transfer line a data word composed of a start pulse, several information units corresponding to the number of bit-parallel input information units forming a data block, and a defined data pause.

The conversion of bit-parallel signals into bit-serial signals and the reverse of this procedure are necessities in teleprocessing and teleprinter communications. This conversion is, however, also used by local computer networks if, for example, a terminal is installed in a different wing of the building than the central processing unit.

With microprocessors, separate peripheral components, so-called Universal Synchronous/Asynchronous Receiver/Transmitter (USART) components, can be used for this conversion. Software solutions are, however, also known wherein standard I/O ports are used.

In the transmission of, for example, teleprinter signals, the data to be transferred are defined by the ASCII Code (American Standard Code for Information Interchange) and the levels on the transmission lines are specially standardized, as, for example, in the case of the voltage interface RS 232 (CCITT recommendation V24).

For certain applications such as, for example, in motor-vehicle electronics, a microprocessor solution for serial data transfer involves too much expenditure if, for example, switch positions for various consumers are to be converted as parallel input information units into a serial data word in order to drive bit-parallel relays as control elements corresponding to the switch positions on the receiver side.

With microprocessors, the bit-parallel input information units are extended via the I/O ports with corresponding addressing and software-related programming expenditure.

SUMMARY OF THE INVENTION

The object underlying the present invention is, therefore, to provide a circuit arrangement for conversion of bit-parallel data into bit-serial data and vice-versa, which requires little circuitry expenditure and no software expenditure, and wherein the number of bit-parallel input and output information units is alterable, if required.

This object is attained in accordance with the invention in that the number of bit-parallel input and output information units is alterable by cascading several transmitting and receiving devices of the same kind, whereby the data word is correspondingly altered on the data transfer line, and by sequential joining of a corresponding number of data blocks, each having the same number of information units per data block.

The essential advantages of the inventive circuit arrangement are that without programming expenditure and by means of transmitting and receiving devices of the same kind, with reference to motor-vehicle electronics, many control lines of a cable harness can be saved, the data transfer reliability is increased by multiple comparison, and an interruption in the data transfer line can be diagnosed.

Further advantageous embodiments of the invention are apparent from the subclaims.

An embodiment of the invention is illustrated in the drawings and is described in detail hereinafter.

BRIEF DESCRIPTION OF THE DRAWINGS

FIG. 6 shows a pulse diagram for the decoding circuits; and

FIG. 7 shows the wiring of the receiving device.

DESCRIPTION OF THE PREFERRED EMBODIMENTS

Figure 1:
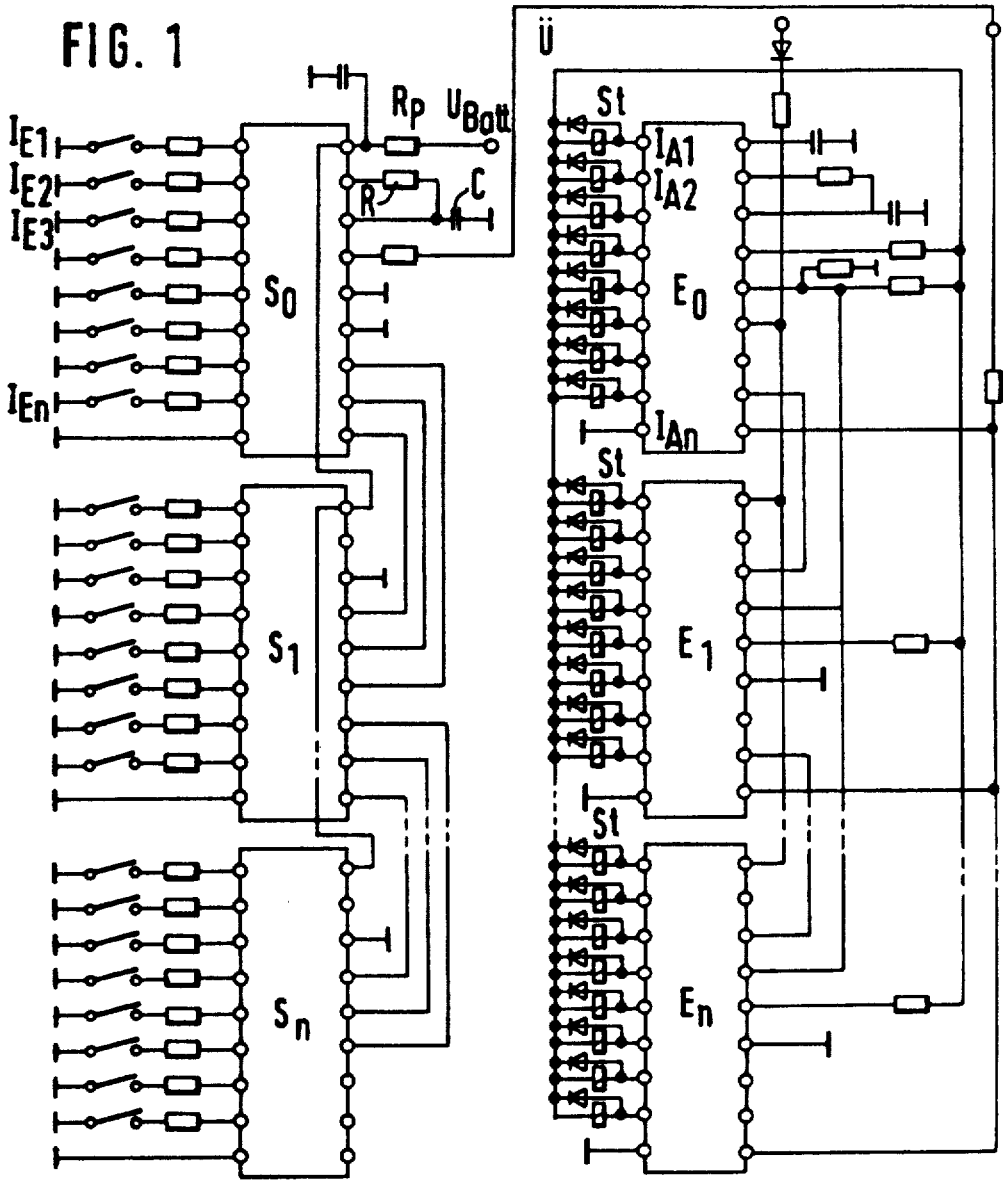
FIG. 1 is a block circuit diagram of several cascaded transmitting and receiving devices for serial data transfer.

The block circuit diagram shown in FIG. 1 is comprised of several transmitting devices $S_o$, $S_1$, . . . $S_n$, of the same kind, a data transfer line Ü and several receiving devices $E_o$, $E_1$, . . . $E_n$.

Figure 2:
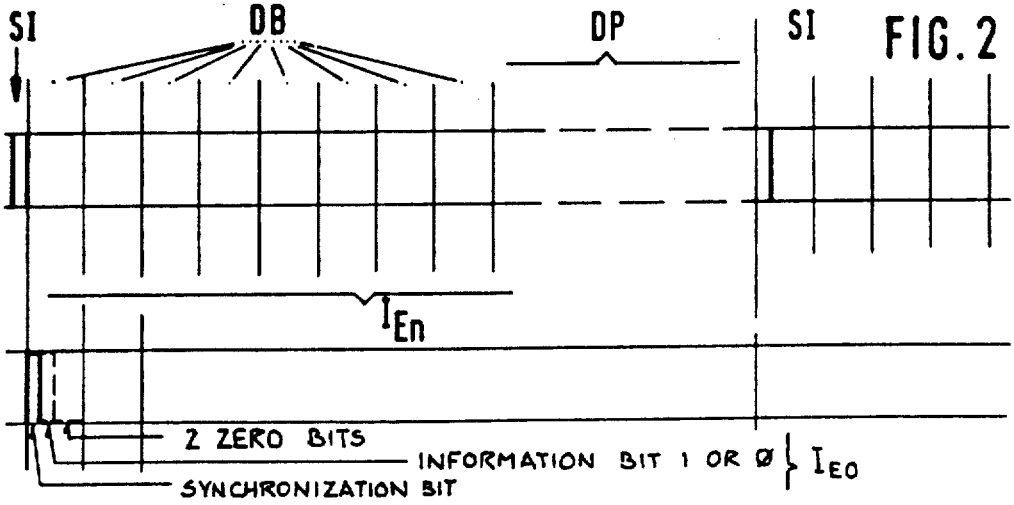
FIG. 2 shows the time-oriented route of a data word.

Each transmitting device $S_n$ comprises the same number of parallel input information units $I_{En}$; in the example shown there are eight, which according to the arrangement of the n transmitting devices $S_n$ are sequentially joined on the data transfer line Ü to form a data word as shown in FIG. 2. On the receiver side, the input information units $I_{En}$ are converted in the associated receiving devices $E_n$ into the same number of corresponding parallel output information units $I_{An}$ to drive relays as control elements (St) or logic circuits directly.

The data word in FIG. 2 consists of a start pulse SI with a pulse duration of, for example, 312 μs followed by several data blocks DB in accordance with the number of bit-parallel input information units, followed by a defined data pause DP.

A data block consists of a synchronization bit with, for example 156 μs, a following information bit of the same time duration, followed by two zero bits of 156 μs duration each.

Figure 3:
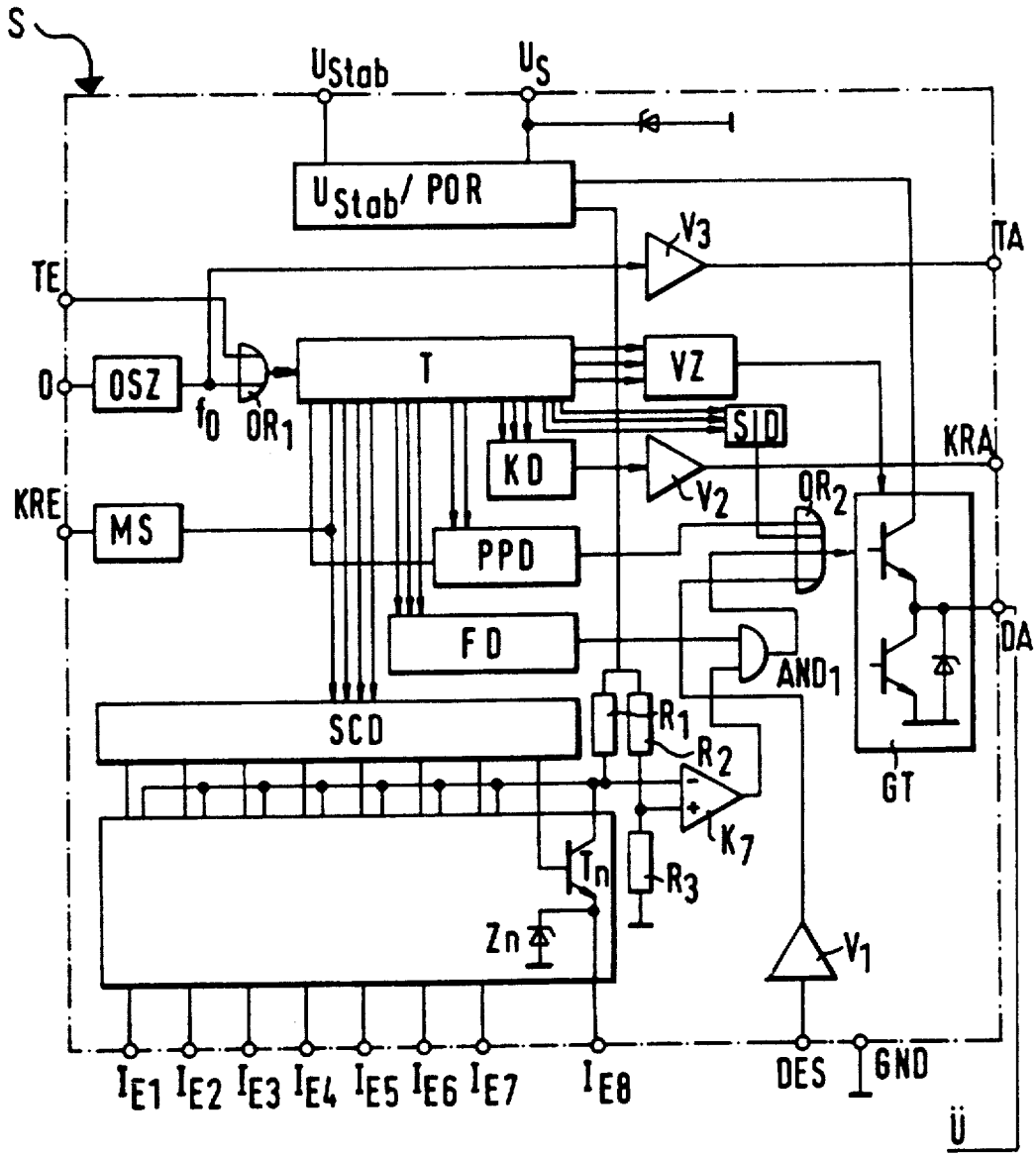
FIG. 3 is a block circuit diagram of the transmitting device.

To this end, each transmitting device S is set up as shown in FIG. 3: Via an internal timing means or oscillator OSZ which can be influenced in its basic frequency by external wiring to terminal 0, a clock frequency $f_o$ is generated and is fed via one input of a clock signal selecting means or first OR gate $OR_1$ to a frequency divider stage T. An external clock generator can be connected to the other input of OR gate $OR_1$ via the clock input terminal TE, in particular, if several transmitting devices $S_n$ of the same kind are cascaded and the clock pulse for all transmitting devices $S_n$ arranged downstream is derived from only one transmitting device, the master, for example, $S_o$. To this end, the oscillator inputs $O_n$ of these transmitting devices arranged downstream are connected to low potential and they then operate as so-called slaves in cooperation with the master.

The following explanations relate to an embodiment of the invention with two transmitting and receiving devices of the same kind.

The frequency divider stage T consists of a chain of fedback bistable multivibrator stages, for example, D flip-flops, so that various frequency divider conditions prevail, and the divided down frequency levels are linked to one another to form the data word via inventive decoding circuits such as start pulse decoder SID, cascade reset decoder KD, pulse pause decoder PPD, release decoder FD and scan pulse decoder SCD. In addition, the frequency divider stage T drives a delay circuit VZ.

The pulse diagram shown in FIG. 6 shows the output signals of the individual decoding circuits.

From the clock frequency $f_o$ of the oscillator output signal according to FIG. 6*a* the following output signals are generated via the decoding circuits:

scan pulses for inquiry of the switch positions according to FIGS. 6*b* to 6*i*;

pulse pause decoder pulse according to FIG. 6*l*;

start pulse according to FIG. 6*k*;

the input information units according to FIG. 6*m* illustrated by an example;

release pulses according to FIG. 6*n*;

the temporarily stored input information units according to FIG. 6*o*;

the actual data word as transmitted on the data transfer line Ü according to FIG. 6*p*;

the output signal of the cascade reset decoder KD according to FIG. 6*q*.

The individual decoded pulses interact as follows:

Each scan pulse $SCI_n$ of the scan pulse decoder SCD is fed to the base of an associated transistor $T_n$ in FIG. 3 whose emitter is connected to the interface of the input information pickup circuit. The terminal pin for this input information $I_{En}$ is also connected to reference potential via a Zener diode Zn poled in the blocking direction. The collectors of all transistors $T_n$ are interconnected and connected to the inverting input of a comparator $K_7$. This input is also connected via a resistor $R_1$ to an operating voltage supply unit $U_{stab}$/POR.

The same operating voltage supply unit $U_{stab}$/POR supplies a voltage divider comprised of the two resistors $R_2$, $R_3$ whose connection point is connected to the non-inverting input of the comparator stage $K_7$.

If the input information $I_{En}$ shows a logic high level of more than, for example, 2.5 V when the scan pulse $SCI_n$ is present, this state is interpreted as open switch and the output signal of comparator $K_1$ is logic zero or low potential. Conversely, if the input information is logic zero or is on low level, i.e., the switch is closed, the output signal of comparator $K_1$ is logic 1 or high level.

The output signals of comparator stage $K_7$ and release decoder FD are linked via an AND gate $AND_1$ whose output signal is fed to an input of a second OR gate $OR_2$ with several inputs. The output signals of the start pulse decoder SID and the pulse pause decoder PPD are fed to the further inputs of this OR gate. Via an amplifier $V_1$ with the data input slave terminal DES, the data of the transmitting device arranged downstream, for example, $S_1$, operated as slave, are fed to a further input of the OR gate $OR_2$ whose output drives a push-pull end stage GT whose output signal represents the data word on the data transfer line Ü.

To transmit a data word W, the push-pull end stage GT is blocked immediately after application of the supply voltage $U_s$ via the output of the delay circuit VZ for a defined time which is determined by counting out a certain frequency level of the divider stage T.

The output signal of the cascade reset decoder KD is fed via a second amplifier circuit $V_2$ to the terminal for the cascade reset output KRA.

Via a third amplifier $V_3$ the signal of the basic frequency $f_o$ is fed to the terminal of the clock output TA.

The feed voltage supply unit $U_{stab}$/POR is fed a supply voltage $U_s$ from which the stabilized voltage $U_{Stab}$ is derived.

The data word W shown in FIG. 6*p* begins with a start pulse of, for example, 312 μs duration and is followed by eight data blocks DB of 624 μs duration each, with each data block beginning with a synchronization bit of 156 μs duration. It is followed by the scanned input information units $I_{En}$, with a logic zero 0 meaning that the respective switch is closed. In the example of FIG. 6*p*, every second switch is, therefore, closed. The information bit is followed by two zero bits of 156 μs each.

Via the master-slave programming stage MS, the frequency divider stages T and the pulse pause decoder PPD can be blocked at logic zero level at their cascade reset input KRE and released at a high level. The switch-over of these levels is effected in cascading operation in the master-slave mode by the cascade reset signal which is generated in the cascade reset decoder KD, is available at the cascade reset output KRA of the master and is fed to the transmitting device arranged downstream which is operated as slave.

A galvanically coupled electric connecting lead may be used as data transfer line Ü. An optoelectronic transfer line which consists on the transmitter side, for example, of a light-emitting diode LED driven by the push-pull end stage GT with the DA terminal of the data output of the transmitting device is, however, also possible. This light-emitting diode pulses the data word W galvanically separated, for example, via a glass fiber onto a phototransistor which is arranged on the receiver side and drives the receiving device connected downstream.

Figure 4:
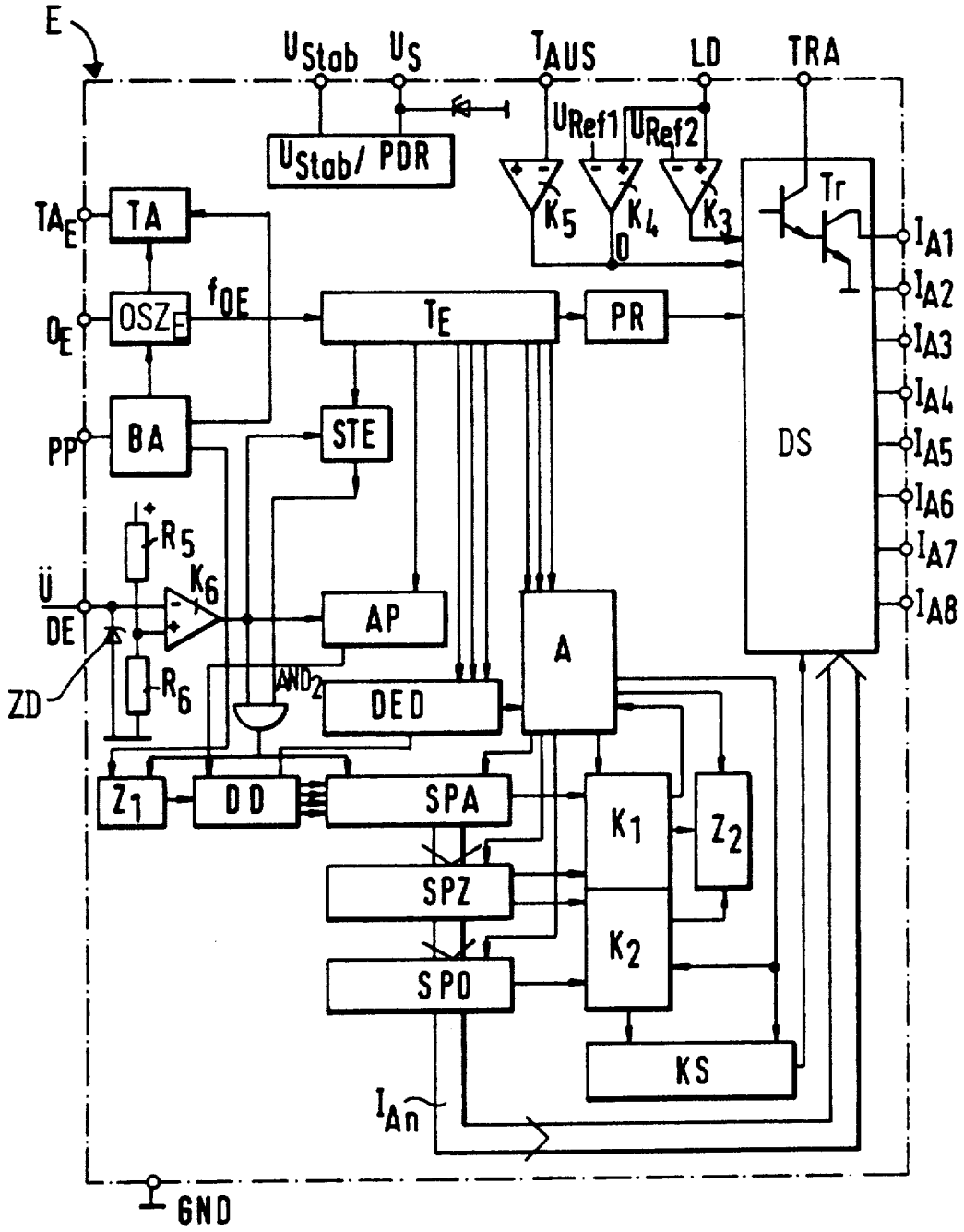
FIG. 4 is a block circuit diagram of the receiving device.

As seen in FIG. 4, a data input DE of each receiving device E is connected to the inverting input of a comparator stage $K_6$ and to the cathode of a Zener diode ZD poled in the blocking direction, whose anode is connected to reference potential. The non-inverting input of this comparator is connected via the center tap of a voltage divider consisting of the resistors R5, R6 to a reference voltage.

The received data word W is brought digitally to a defined voltage level by the comparator $K_6$ for further processing in the receiving device E and is fed to a start pulse recognition circuit STE, a scanning pulse generator stage AP and an input of an AND gate $AND_2$. The AND gate $AND_2$ is released when the start pulse has been detected in the start pulse recognition circuit STE and the other input of the AND gate $AND_2$ is driven with this signal. The start pulse recognition circuit STE is driven by a divided down frequency level of a frequency divider stage $T_E$ of the receiving device E, in which after termination of the data pause a counting-out test is made with the first negative edge as to whether a minimum pulse duration which can be interpreted as start pulse is present. For this purpose, the frequency divider stage $T_E$ is driven by an internal timing means or oscillator circuit $OSZ_E$ with the terminal $O_E$ of the receiving device E whose basic frequency level $f_{oE}$ is approximately four times greater than that of the transmitting device. The oscillator $OSZ_E$ can be blocked or released via the output of clock signal selecting means or operating mode storage BA by its terminal, the programming pin PP, being connected to high or low potential.

The basic frequency $f_{oE}$ of the oscillator $OSZ_E$ is fed in addition to a clock output stage TA with the terminal $TA_E$ whose function is likewise determined by a corresponding control signal of the operating mode storage BA.

The frequency divider stage $T_E$ drives further component groups of the receiving device E with differently divided down frequency levels. These include the scanning pulse generator stage AP, a data end decoder DED which recognizes the end of the transferred data and informs a sequential control A of this point in time. The sequential control A is likewise driven by various frequency levels of the divider stage $T_E$. The received data word is further processed via a first counting device $Z_1$ which is driven via a further output signal of the operating mode storage Ba and counts out the first eight bits as master receiver or the second eight bits as slave receiver accordingly. In addition, the counter $Z_1$ is fed the output signal of the AND gate $AND_2$.

The output of the counter $Z_1$ and the output of the scanning pulse generator stage AP drive a data decoding circuit DD whose control lines assume a distributor function by being connected to the clock inputs of a cache SPA connected downstream which consists of clock-controlled D flip-flops. The output signal of the AND gate $AND_2$ which is identical to the data word is present at all data inputs of these D flip-flops. In this way, only the input information units $I_{En}$ are read successively at the rate of the scanning pulse into the flip-flops of the cache SPA and are, therefore, available as bit-parallel information. An identical temporary storage SPZ is connected downstream from the cache SPA.

The information units read into the cache SPA are compared with the contents of the temporary storage SPZ by a comparing unit K1 after recognition of the end of the data. In the case of equivalence, a second counter $Z_2$ which operates as three-bit counter is counted one stage further. The comparison of the data contents of cache SPA and temporary storage SPZ is made in the comparator stage $K_1$ which in the case of equivalence delivers a control signal to the counter $Z_2$ and the sequential control A.

In the case of nonequivalence, the counter $Z_2$ is reset via the sequential control A. The sequential control A also drives the storages SPA, SPZ and SPO and the comparators $K_1$ and $K_2$. After each comparison, the data are transferred from the cache SPA to the temporary storage SPZ. After four instances of equivalence, the contents of the temporary storage SPZ are compared with the contents of the output storage SPO connected downstream therefrom via a comparator stage $K_2$. In the case of equivalence, the counter $Z_2$ is reset since the input information units $I_{En}$ have not changed. In the case of nonequivalence, the input information units have changed and the following procedure takes place: The information units are taken over from the temporary storage SPZ into the output storage SPO and transferred to the driver stages connected downstream from the output storage SPO where they are available as bit-parallel output information units $I_{An}$ to drive control elements or logic circuits.

An output of the comparator $K_2$ and a control line of the sequential control A are connected to a short-circuit recognition circuit KS which, after approximately 35 ms, following output of the data from the output storage SPO to the driver stages DS, tests these for approximately 10 ms for short-circuit behavior. To this end, the collector-emitter voltages of the active driver stages which as open collector transistors are provided with the terminals TRA and $I_{An}$, respectively, are successively inquired four times via a comparator stage to ensure that there is no disturbance pulse present. If a short-circuit signal lasts for approximately 10 ms, the corresponding transistor is blocked. The blocked state remains stored and can only be cancelled again by the feed voltage supply unit $U_{stab}$/POR being switched off and switched on again by a so-called "Power On Reset" component designed in the same way as that of the transmitting device.

A further protective measure for the driver stages is carried out by a safety test device PR which is driven by a frequency level of the frequency divider stage $T_E$. This ensures that in the event of a break in electrical continuity or a short-circuit of the data transfer line Ü, all driver outputs are blocked after a defined time of approximately 50 ms. The disturbance can be indicated optically or acoustically if an input information unit of the transmitting device is constantly set to reference potential on a logic low level and the corresponding output is wired in accordance with FIG. 7.

Further component groups of the receiving circuit are three comparators $K_3$, $K_4$, $K_5$ whose output signals act upon the driver stages.

If, for example, relays are driven by the output stages, they can be statically driven for approximately 120 ms after switch-on. During this time, the short-circuit testing of the outputs also takes place. The outputs can then be driven in a clocked manner with the basic frequency of the oscillator of the receiving circuit $f_{oE}$ to reduce the power dissipation in the driver stages. The operating mode for static or clocked driving of the outputs can be determined by the terminal pin $T_{Aus}$ with the non-inverting input of the comparator $K_5$, and the driving is carried out statically when $T_{Aus}$ is connected to the supply voltage $U_s$. Connection with reference potential results in clocked driving.

The non-inverting inputs of the comparators $K_4$ and $K_3$ are interconnected and lead out to the terminal LD. The output of the comparator $K_4$ is connected to the output of the comparator $K_5$. The input LD senses the voltage of the board network.

If the voltage level of the board voltage available at the terminal LD via a voltage divider is below a set reference voltage $U_{Ref1}$ present at the inverting input of the comparator $K_4$, the clocked driving of the relays is stopped via the comparator output of $K_4$.

In the case of positive voltage peaks and high disturbance pulses, the driver transistors of the driver stages DS are brought into the conducting state via the output of the comparator $K_3$ at whose inverting input the reference voltage $U_{Ref2}$ is present. Also, in the case of positive over-voltages, each short-circuit inquiry is stopped.

Cascading (master-slave-operation) of the receiving device is discussed hereunder.

Master or slave is determined by wiring of the programming pin PP:
Master: PP to Us
Alone: PP open
Slave: PP to ground.

In the master operating mode, the oscillator $OSZ_E$ is wired at the pin $O_E$ to an RC element and the clock output $TA_E$ is active. If the receiver is operated alone, $TA_E$ is blocked.

In the slave operating mode, the oscillator is blocked and must be driven by the clock output of the master; the clock output of the slave is blocked.

Data recognition: The master recognizes the start bit and decodes the first 8 information bits. The slave likewise recognizes the start bit, but decodes the second 8 information bits.

With the exception of the synchronous clock control, the functions in master and slave are performed independently of one another.

Figure 5:
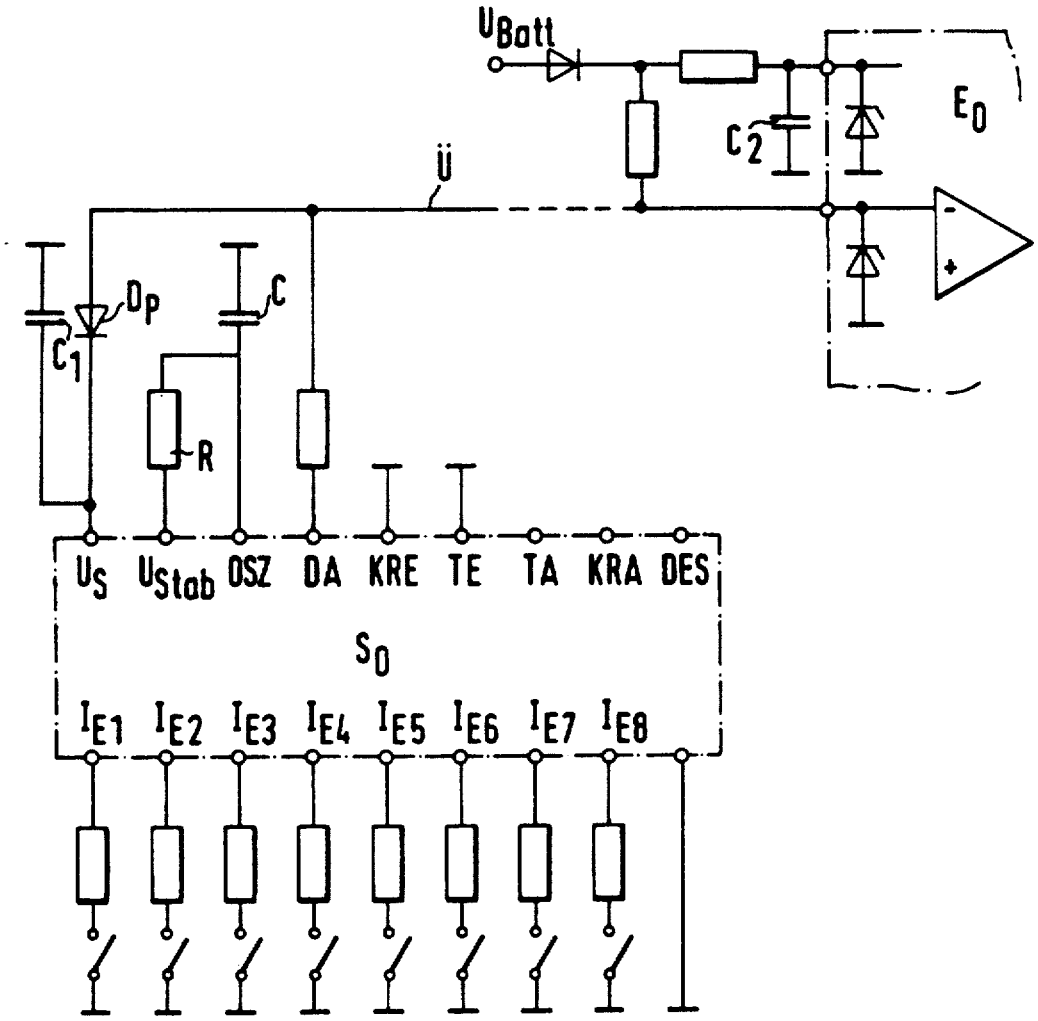
FIG. 5 shows a circuit arrangement for supplying the transmitting device with feed voltage via the data transfer line.

FIG. 5 shows a way in which the transmitting device $S_o$ can be wired. The transmitting device is supplied with feed voltage via the data transfer line Ü. To this end, the resistor $R_p$ in FIG. 1 is replaced by the diode $D_p$, and the cathode is connected with the terminal pin $U_S$ of the transmitting device $S_o$ and the anode directly with the data transfer line Ü.

The circuit blocks illustrated in FIGS. 3 and 4 are completely monolithically integratable.

What is claimed is:

1. Circuit arrangement for parallel-serial-parallel data transfer, comprising:

a cascaded plurality of transmitting means, which are similar, coupled to a plurality of cascaded receiving means, which are similar, by a serial data transfer line, each of said transmitting means receiving a respective plurality of bit-parallel input information units and converting them into serial data in the form of a corresponding data block, and each of said receiving means correspondingly converting serial data into a plurality of bit-parallel output information units;

said cascaded plurality of transmitting means being sequentially connected and producing serial data which is transferred on said serial data transfer line, said serial data being composed of data words, each data word having a start pulse, a plurality of information units corresponding to a predetermined number of bit-parallel input information units which together form a data block, and a defined data pause, wherein said predetermined number of bit-parallel input information units, which can be assembled into a data block, is determined by the number of cascaded transmitting and receiving means;

each of said transmitting means having internal clock means for producing an internal timing signal, a clock input terminal for receiving an external timing signal, and first master-slave-programming means, responsive to a control signal, for causing said transmitting means to operate as either a transmitting means master stage or a transmitting means slave stage such that each data word on said data transfer line is formed by sequential joining of a corresponding number of data blocks each having the same number of information units, said first master-slave-programming means including first means for selecting one of said internal timing signal and said external timing signal, wherein each of said transmitting means operating as a transmitting means slave stage is responsive to said external timing signal, only one of said cascaded plurality of transmitting means being said transmitting means master stage and producing said control signal and said external timing signal for each said transmitting means slave stage, and said transmitting means master stage being responsive to said internal timing signal;

each of said receiving means having internal clock means for producing an internal timing signal, a clock input terminal for receiving an external timing signal, and second master-slave-programming means for causing said second master-slave-programming means to operate as either a receiving means master stage or a receiving means slave stage, said second master-slave-programming means including second means for selecting as said timing signal one of said internal timing signal and said external timing signal, only one of said cascaded plurality of receiving means being said receiving means master stage and producing said external timing signal for each said receiving means slave stage each of said transmitting means further comprising first cascading circuit means operable in conjunction with said first master-slave-programming means for sequentially joining its corresponding data block to the ones of said data blocks on said data transfer line, said ones of said data blocks being respectively joined corresponding to the sequence in which said transmitting means are connected, said first cascading circuit means including an externally programmable storage means; and each of said receiving means further comprising second cascading circuit means operable in conjunction with said second master-slave-programming means for causing said data blocks to be respectively decoded by corresponding ones of said receiving means, said second cascading circuit means including a programmable storage device.

2. Circuit arrangement according to claim 1, wherein each said transmitting means further comprises a push-pull end stage means for causing data output from each said transmitting means to said data transfer line, each said push-pull stage means having current limitation.

3. Circuit arrangement according to claim 1, wherein each said receiving means further comprises a cache means for receiving and storing input information units having a received bit pattern, a temporary storage means connected to receive an output from said cache means for receiving and storing input information units having a received bit pattern, an output storage means for receiving and storing input information units having a received bit pattern, said output storage means being connected to receive output from said temporary storage means, a first comparator means for comparison of the contents of said cache means with the contents of said temporary storage means, a second comparator means for comparing the contents of said temporary storage means with the contents of said output storage means, and a counter means, whereby the transfer reliability of transmitted data on said data transfer line is increased with respect to disturbing influences by each of said receiving means inquiring the same input information units a plurality of times and subsequently comparing the received bit pattern in said first and second comparing means followed by (a) subsequent incrementing of said counter means in the case of determination of equivalence of the received bit pattern until a predetermined number is reached, and (b) resetting of said counter means and renewed inquiry of the input information units in the case of determination of non-equivalence of the received bit pattern.

4. Circuit arrangement according to claim 1, wherein each said receiving means further comprises a plurality of driver stages for producing bit-parallel output signals from input information units having a received bit pattern, and means for blocking each of said driver stages after a predetermined response time in event of a short-circuit as well as in event of a break in electrical continuity of said data transfer line.

5. Circuit arrangement according to claim 1, wherein said data transfer line includes an optoelectronic transmitting device on a transmitting side thereof for transmitting said serial data, and includes on a receiving side thereof a glass fiber and an optoelectronic receiving data for receiving said serial data.

6. Circuit arrangement according to claim 1, wherein an interruption in said serial data transfer line is indicated by acoustical means via an electroacoustic transducer unit, said interruption being indicated by one of the bit-parallel input information units which is constantly set to reference potential, and said electroacoustic transducer unit being connected in an associated bit-parallel driver stage.

7. Circuit arrangement according to claim 1, further comprising a feed voltage supply means connected to said data transfer line for supplying voltage to said transmitting means.

8. Circuit arrangement according to claim 1, further comprising a plurality of bit-parallel driving stages in each of said receiving means, and means for causing said driver stages to be in a conducting state in event of relatively high voltage peaks of a supply voltage which is supplied to said plurality of cascaded receiving means.

9. Circuit arrangement according to claim 1, further comprising a means for selectively driving said bit-parallel output information units in a clocked manner to minimize power dissipation.

10. Circuit arrangement according to claim 1, further comprising a plurality of bit-parallel driving stages in each said receiving means for driving said input information units having a received bit pattern, and a means for testing said bit-parallel driver stages for short-circuit behavior by successively inquiring the collector-emitter voltages of each of said bit-parallel driver stages a plurality of times within a predetermined time interval in which said bit-parallel driver stages are brought into a conducting state.

11. Circuit arrangement according to claim 1, wherein an interruption in said serial data transfer line is indicated by optical means via a light-emitting diode, said interruption being indicated by one of the bit-parallel input information units which is constantly set to reference potential, and said light-emitting diode being connected in an associated bit-parallel driver stage.

* * * * *